United States Patent [19]

Vaynkof

[11] 4,362,439

[45] Dec. 7, 1982

[54] HYDROSTATICALLY OPERATED UNDERWATER PILE DRIVER AND METHOD OF OPERATING SAME

[76] Inventor: Peter P. Vaynkof, 916 Creekside Dr., Fullerton, Calif. 92633

[21] Appl. No.: 239,353

[22] Filed: Mar. 2, 1981

[51] Int. Cl.[3] ..... E02D 7/20

[52] U.S. Cl. ..... 405/228; 114/295; 173/DIG. 1

[58] Field of Search ..... 405/228, 232, 224–227; 173/DIG. 1, 127; 175/6; 114/293–295

[56] References Cited

U.S. PATENT DOCUMENTS

| | | | |
|---|---|---|---|
| 3,721,095 | 3/1973 | Cheminski | 405/232 |
| 3,820,346 | 6/1974 | Wisotsky | 405/228 |
| 3,832,858 | 9/1974 | Anders | 405/232 |
| 4,098,355 | 7/1978 | Gendron et al. | 173/DIG. 1 |

*Primary Examiner*—Dennis L. Taylor
*Attorney, Agent, or Firm*—William C. Babcock

[57] ABSTRACT

An underwater pile driver assembly that includes a vertically disposed tubular housing that may slidably engage the upper end portion of a pile, with the housing having an upper open end, and the housing supporting an anvil that may be placed in abutting contact with the pile. An impact imparting ram is slidably and sealingly mounted in the housing, and may be successively raised to a first position therein. Pump means are provided to successively evacuate water from the interior of the housing between the ram and anvil. After each evacuation the ram is released to be forced downwardly by the hydrostatic head imposed on the upper surface thereof to impact the anvil, with the force imparted to the anvil being transverse to the pile to drive the latter downwardly. The greater the distance of the upper end of the housing from the surface of the water, the greater will be the magnitude of the downward force exerted on the pile each time the ram impacts the anvil. The ram has at least one transverse opening therein that has a movable member operatively associated therewith. On the downward movement of the ram the member closes the opening, and on the upward stroke of the ram the closure member moves to a second position to allow the interior of the housing to be flooded with water, and equalize the water pressure above and below the ram to permit it to be raised to the first position with a minimum of energy.

9 Claims, 11 Drawing Figures

HYDROSTATICALLY OPERATED UNDERWATER PILE DRIVER AND METHOD OF OPERATING SAME

BACKGROUND OF THE INVENTION

1. Field of the Invention

Hydrostatically operated underwater pile driver.

2. Description of the Prior Art

In the past, various types of underwater pile drivers have been designed and used, which pile drivers in the main are actuated by sudden bursts of high pressure air or gas. Such prior art devices due to the high internal pressures to which they are momentarily subjected must be of massive and expensive structure, as well as requiring support equipment that is likewise expensive.

A major object of the present invention is to provide an underwater pile driver that eliminates numerous operational disadvantages inherant to prior art devices of this nature.

Another object of the invention is to furnish an underwater pile driver that has a relatively simple mechanical structure, requires a minimum of maintenance attention, may be fabricated from standard commercially available materials, and is relatively inexpensive when compared with prior art devices of this nature.

A further object of the invention is to supply a pile driver in which a ram is forced downwardly in a tubular housing due to the hydrostatic head above the ram, with this hydrostatic head causing the ram in impact on an anvil that is in abutting contact with the upper end of a pile, and the pile being driven downwardly due to the force transferred to it from the anvil.

Yet another object of the invention is to furnish an underwater pile driver that employs a minimum of energy in returning the ram from the anvil impacting position to an upper portion of the housing, due to the hydraulic pressure on both the upper and lower sides of the ram being equalized as it is moved upwardly in the housing.

SUMMARY OF THE INVENTION

The hydrostatically actuated underwater pile driver of the present invention may be suspended at a desired distance below the surface of the water by conventional means now employed in suspending prior art underwater pile drivers.

The underwater pile driver of the present invention includes a tubular vertically disposed housing that has an upper first open end and a lower second open end that is capable of slidably engaging the upper end of the pile that is to be driven.

An anvil is disposed within the tubular housing and abuts against the upper extremity of the tubular pile that is to be driven. A ram is slidably and sealingly disposed in the housing, with the ram having at least one opening extending transversely therethrough. Each transverse opening has a member movably associated therewith, which member may be moved to a first position to obstruct the opening, or a second position where it does not obstruct the opening.

The upper end of the housing has a stop extending inwardly therefrom that engages the ram when the latter has been raised to a maximum upper position. When the ram is in the uppermost position, movable support means are actuated to extend under the ram and support the latter in a fixed position relative to the housing. The lower end of the housing above the anvil has an opening formed therein that is connected to a conduit that is in communication with a confined space defining structure. The confined space defining structure has a power operated pump operatively associated therewith that may withdraw water from the interior of the structure. A valve is positioned in the conduit that extends from the opening in the housing to the interior of the confined space defining structure.

Power operated means are provided for moving the ram upwardly in the housing from the anvil impacting position to the first upper position, with this movement taking place when the members are in the second positions to permit water to flood the interior of the housing and the top and bottom of the ram being subjected to equal hydraulic pressure.

The invention is used by placing the valve in the open position and causing the pump to evacuate water from the interior of the housing between the ram in the uppermost position and the anvil into the confined space defining structure. The members of the ram are in the first position and close the transverse opening in the ram. The ram is now subjected to the hydrostatic head of the column of water thereabove.

After the water has been evacuated from the housing, the valve is allowed to remain in the open position, and the support means are moved to a second position to allow the hydrostatic head above the ram to move the latter downwardly to impact on the anvil. The force of the impact is transferred to the pile to drive the same downwardly. The valve is now placed in the closed position, and the members moved to the second position, with the interior of the housing flooding with water.

The ram may now be moved upwardly in the housing by power operated means to the first position, the support means are moved thereunder, and the valve now placed in the open position. The water is again evacuated from the interior of the housing, with the members being disposed in the first position to close the openings through the ram to subject the ram to a hydrostatic head thereabove. During this time the support means are in the first position.

The operation above described is sequentially repeated until the pile is driven to a desired depth. It will be apparent that for the invention above described to operate, that the uppermost portion of the housing must be a substantial distance below the surface of the water in which the housing is emerged. The greater the depth of the housing, the greater will be the hydrostatic force exerted downwardly on the ram each time it moved from the first position to the anvil contacting position.

DESCRIPTION OF THE PREFERRED EMBODIMENT

Figure 1:
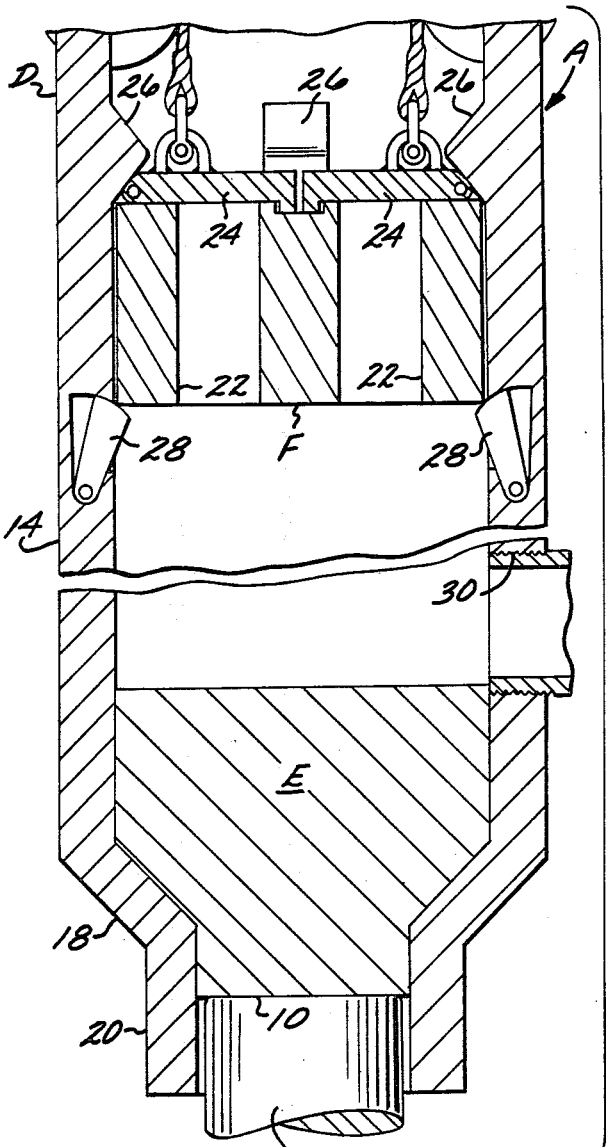
FIG. 1 is a longitudinal cross sectional view of the underwater pile driver, with the ram being held in the uppermost position by supports that are pivotally supported from the housing in which the ram is disposed.

The hydrostatically actuated underwater pile driver A is shown in structual detail in FIGS. 1 to 4, with FIGS. 5 to 11 illustrating the manner in which the pile driver operates. In FIG. 1 it will be seen that the pile driver A is in engagement with a pile B that has an upper end portion 10, with the pile driver being situated a substantial distance below the surface 12 of the body of water C as shown in FIGS. 6 to 11.

The pile driver A includes a housing assembly D. The housing assembly D includes an elongate tubular member 14 that has an upper open end 16 as may be seen in FIG. 3, with the tubular member developing on the lower portion thereof into a frusto-conical portion 18, which portion has a cylindrical sleeve 20 extending downwardly therefrom that slidably engages the upper portion of the pile B that is to be driven as shown in FIGS. 1 and 4.

Figure 4:
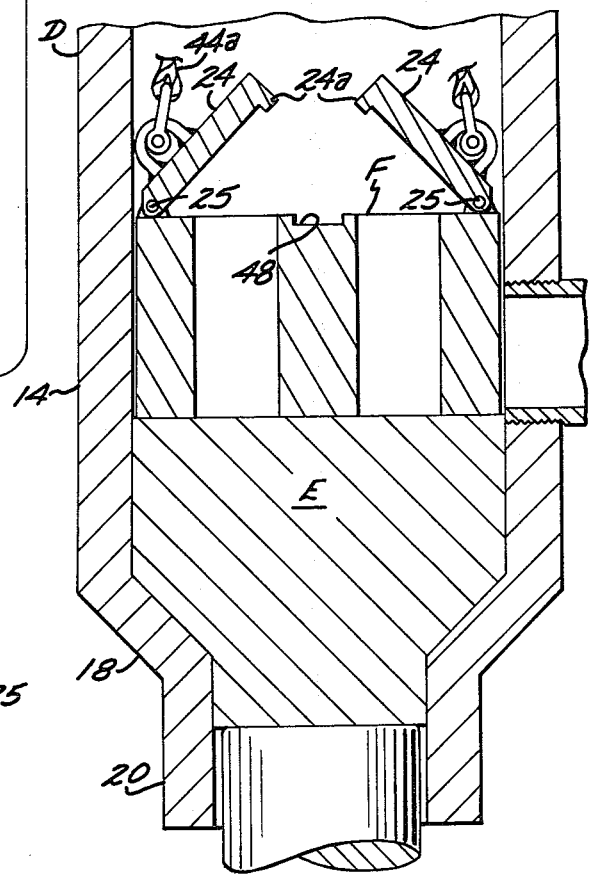
FIG. 4 is a second fragmentary longitudinal cross sectional view of the underwater pile driver illustrating the lower portion thereof, and the ram having moved downwardly to impact on the anvil that is in abutting contact with the pile being driven.

The pile driver A is illustrated in FIGS. 1 and 4 as having an anvil E situated within the interior thereof, which anvil occupies a lower part of the tubular member 14, the portion 18, and the upper part of the sleeve 20.

A ram F of sturdy construction is slidably disposed in the tubular member 14, with the ram capable of occupying either an upper first position as shown in FIG. 1, or a lower second position as shown in FIG. 4 in which it is in abutting contact with the anvil E. The ram F is illustrated in the drawings as having four spaced openings 22 extending transversely therethrough, which openings have closure members are illustrated as being pivotally supported on hinges 25 that are secured to the upper portions of the ram F as may be seen in FIG. 4. A number of stops 26 extend inwardly from the upper interior portion of the tubular member 14 as may be seen in FIGS. 1 and 3, with the stops serving to limit the upward movement of the ram to the first position. The tubular member 14 as may be seen in FIG. 1 and 3 has a number of circumferentially spaced slots 27 formed therein in which supports 28 are pivotally mounted on pins 29.

The supports 28 as shown in FIG. 1 may occupy inwardly extending first positions in which they engage the lower peripheral edges of the ram F, to removably support the ram in the first upper position. When the supports 28 are pivoted outwardly away from one another into slots 28 to occupy second positions the supports no longer engage the ram F, and the ram may move downwardly.

In FIG. 1 it will be seen that a transverse opening 30 is formed in the tubular member 14 slightly above tha anvil E. In FIGS. 7 to 11 inclusive it will also be seen that a confined space defining structure G is provided that may be either above or below the surface 12 of the body of water C. The structure G has a power driven pump 32 so associated therewith, that the suction 33 of the pump is in communication with the interior of the structure G and the discharge 35 of the pump discharging water from the interior structure outwardly therefrom. The structure G has an opening 36 therein from which a conduit 34 extends to the opening 30 in a tubular member 14.

Figure 7:
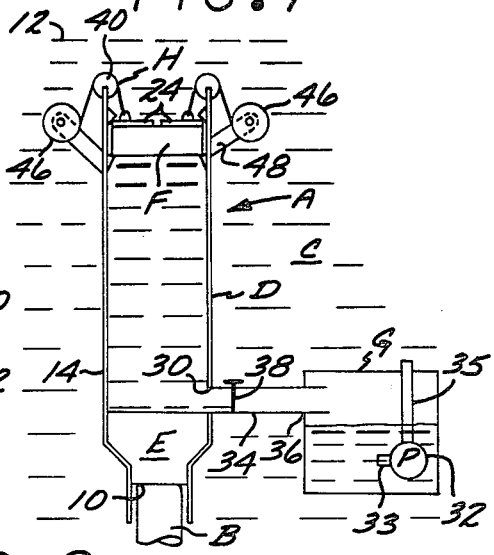
FIG. 7 is a diagrammatic view of the underwater pile driver with the ram in the uppermost position and the interior of the housing filled with water.
Figure 8:
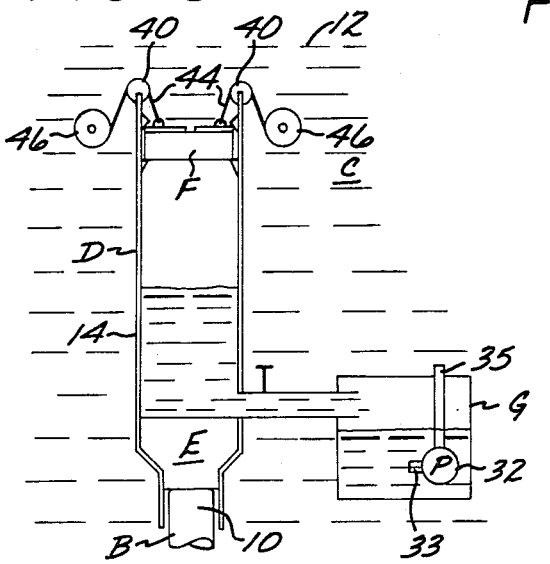
FIG. 8 is the same view as shown in FIG. 7, but after a power driven pump has partially evacuated water from the interior of the pile driver housing assembly.
Figure 9:
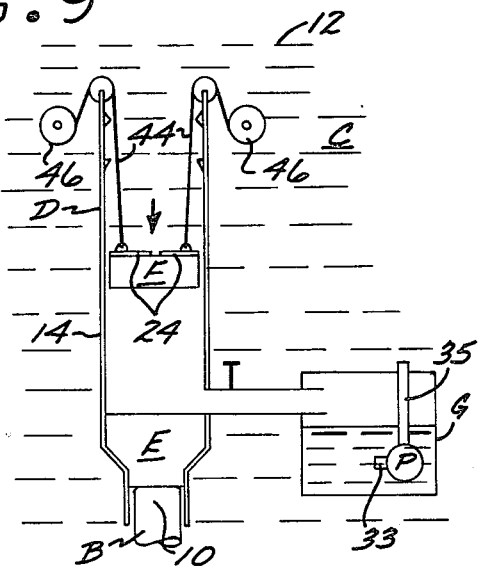
FIG. 9 is again the same view as shown in FIG. 7, after water has been evacuated from the interior of the pile driver housing and the ram is moving downwardly to forcefully contact the anvil, and the anvil in turn transferring this force to the housing engaged pile to drive the engaged pile downwardly.
Figure 10:
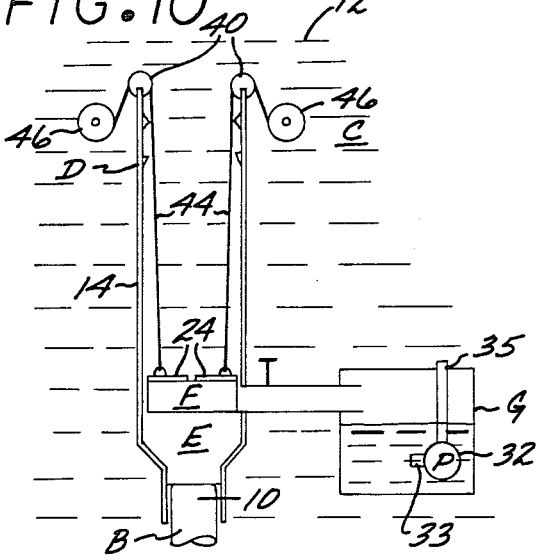
FIG. 10 is another diagrammatic view of the underwater pile driver and after the ram has contacted the anvil.
Figure 11:
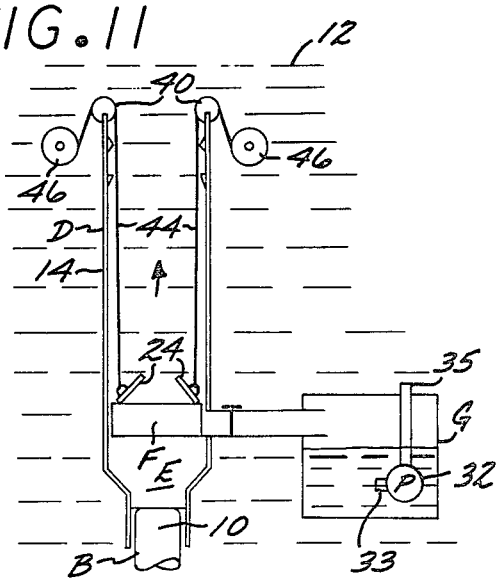
FIG. 11 is a still further diagrammatic view of the underwater pile driver after the valve has been closed that is in the conduit that extends between the interior of the housing and a confined space defining structure, with the members that close the transverse openings in the ram now having been moved to open positions prior to the ram being returned to the uppermost positions shown in FIG. 7.

The conduit 34 has a valve 38 therein, which may occupy either a closed position as shown in FIGS. 7 and 11 or an open position as illustrated in FIGS. 8 to 10 inclusive.

Figure 3:
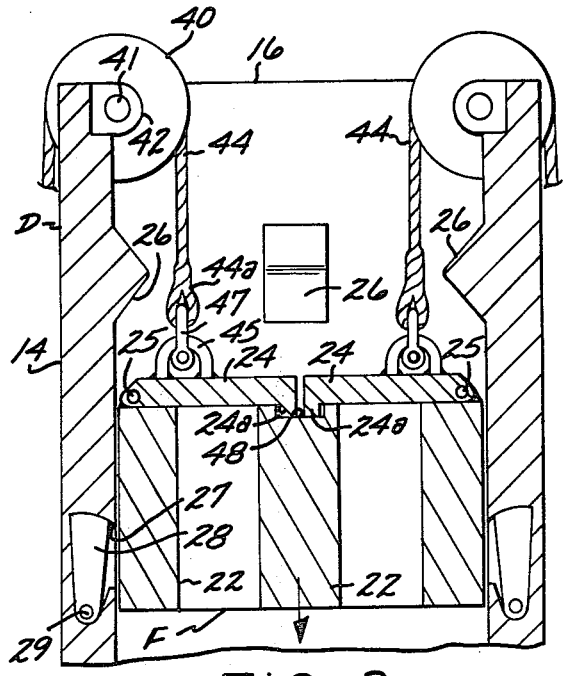
FIG. 3 is a fragmentary longitudinal cross sectional view of the underwater pile driver illustrating a part of the lifting assembly for returning the ram to the uppermost position.
Figure 2:
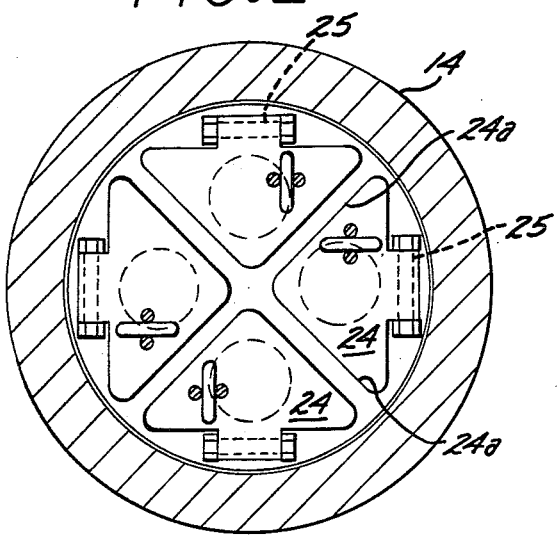
FIG. 2 is a top end view of the underwater pile driver shown in FIG. 1.

A ram moving assembly H is shown in FIGS. 2, and 7 to 11 inclusive, for moving the ram F upwardly from the second position shown in FIG. 11 to a first position illustrated in FIG. 7 where the ram is maintained by the supports 28. The assembly H includes a number of pulleys 40 as shown in FIG. 3 that are rotatably mounted on transverse shafts 41 that extend between U-shaped brackets 42. Each of the members 24 has an eye 45 extending upwardly therefrom that is engaged by a shackle 47 or other conventional means to a looped end 44*a* of a cable 44, which cable extends over one of the pulleys 40 to wind and unwind from a power driven reel 46 as may be seen in FIGS. 7 to 11. Each of the power driven reels 46 is supported from the tubular member 14 by a conventional support 48.

The reels 46 are of conventional design, and are of such structure that they include a brake mechanism (not shown) to maintain them in a fixed position, and also a clutch (not shown) to cause the prime mover that forms a part of the reel structure to either rotate the reel in a direction to lift the ram upwardly within the tubular member 14 or allow the reel to rotate freely and permit the ram to move downwardly in the tubular member. When the clutch (not shown) is released, as well as the brake (not shown), the reel 46 is free to rotate and allow the ram F to move downwardly due to the hydrostatic head thereabove when the members 24 are in the closed first position as shown in FIG. 3. When the members are in the closed position, downwardly extending lips 24*a* on the sides thereof sealingly engage recesses 48 formed in the upper portion of the ram F.

When the ram F is in the first and uppermost position as shown in FIG. 1, the supports 28 are pivoted endwardly to engage the lower peripheral portion of the ram, with the upper portion of the ram being in abutting contact with the stops 26. The power driven reels 46 are now placed in a condition whereby they may rotate freely as the ram F subsequently is driven downwardly in the tubular member 14 by the hydrostatic head above the ram as shown in FIG. 7.

The valve 38 is now moved from the closed position illustrated in FIG. 7 to the open position illustrated in FIG. 8. Pump 32 is now caused to be driven to evacuate water from the interior of the housing member 14 into the confined space defining structure G. After the water has been evacuated from the tubular member 14, the supports 28 are moved from the first positions shown in FIG. 1 to second positions illustrated in FIG. 3. The brake and clutch (not shown) on the power driven reels 46 are released. The hydrostatic pressure exerted by the water above the members 24 tends to maintain them in the sealing position shown in FIG. 3.

The ram F due to the hydrostatic force exerted downwardly therein moves downwardly in the tubular member 14 from the position illustrated in FIG. 8, through the position shown in FIG. 9 until the ram impacts the anvil E as illustrated in FIG. 10. The force of this impact is transferred from the anvil E to the housing engaged pile B to drive the latter downwardly.

Valve 38 is now closed as shown in FIG. 11, with the power driven reels 46 being actuated to draw the ram F upwardly in the tubular member 14. As the cables 44 exert an upward pull, the tubular members 24 pivot from first to second positions to allow water to discharge downwardly through the transverse openings 22 in the ram for the hydraulic pressure within the tubular member 14 to be equal both above and below the ram.

Due to this equalization and pressure, a minimum of energy is required by the power driven reels 46 in raising the ram F upwardly from the second position shown in FIG. 11 to the first position illustrated in FIG. 7. The operation is then again repeated to impact the pile B until the latter is driven to a desired depth.

Figure 5:
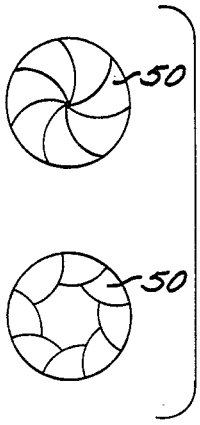
FIG. 5 is a diagrammatic view illustrating a second form of means for closing the transverse openings that extend through the ram.
Figure 6:
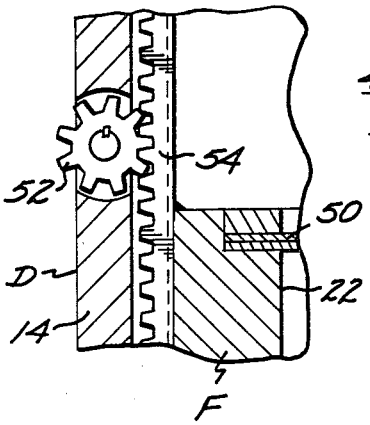
FIG. 6 is a fragmentary longitudinal cross sectional view of the housing and illustrating a second mechanism in the form of a rack and pinion assembly that may be used to move the ram from the anvil contacting position to the uppermost position and the interior of the housing filled with water.

The closing of the openings 22 in the ram F is not limited to the use of members 24 as illustrated in FIG. 3, but may be a series of blades 50 such as illustrated in FIG. 5 that may be pivoted from a closed position illustrated in this figure to the open position also illustrated in the figure therebelow. Likewise, the raising of the ram from the second to the first position as illustrated in FIGS. 10 and 7 is not limited to the use of cables 44 and power driven reels 46, but instead may be by power driven sprockets 52 as shown in FIG. 6 that engage toothed racks 54 secured to the ram F.

The use and operation of the invention has been explained previously in detail, and need not be repeated.

What is claimed is:

1. A device capable of being disposed a substantial distance below the surface of a body of water to drive a pile having an upper end by the hydrostatic force exerted downwardly on said device, said device including:

a. a housing assembly that includes an elongate tubular member that has upper and lower open ends, said lower open end capable of slidably engaging said upper end of said pile when said device is vertically disposed and coaxially aligned with said pile; an anvil in said tubular member in contact with said upper end of said pile; a ram slidably movable in said tubular member, said ram capable of occupying either a first position adjacent said upper open end or a second position in contact with said anvil; and a stop that limits said ram from being moved upwardly above said first position in said tubular member, said ram having at least one opening extending transversely therethrough, said anvil, an intermediate portion of said tubular member and said ram defining a first confined space when said ram is in said first position, said tubular member having an opening therein;

b. first means on said ram that when in a first position obstructs said opening and in a second position does not obstruct said opening;

c. second means for raising said ram from said second to said first position;

d. third means for removably supporting said ram in said first position; and e. fourth means in communication with said opening for evacuating water from said first confined space when said ram is in said first position and said first means in said first position, with said ram when released by said third means being driven downwardly in said tubular member by the weight of a column of said water thereabove to impact on said anvil, and the force of said impact being transferred from said anvil to said pile to drive the latter downwardly, with said first means being moved to said second position, said second means moving said ram to said first position with water from said body of water exerting equal but oppositely directed forces on the top and bottom of said ram, said support means removably engaging said ram when the latter reaches said first position in said tubular member with said ram being successively moved between said first and second positions until said pile has been driven to a desired depth.

2. A device as defined in claim 1 in which said first means is a member pivotally supported from an upper surface of said ram adjacent said opening that seals with said ram when said member is in said first position.

3. A device as defined in claim 1 in which said second means is an assembly that includes a cable that extends upwardly from said ram, and a power driven reel that occupies a fixed position relative said tubular member, said cable winding and unwinding from said reel, and said reel allowing free downward movement of said cable when said reel is not power driven.

4. A device as defined in claim 3 in which said cable is connected to said pivotally supported member and moves said member to said second position when said cable is tentioned to move said ram upwardly in said tubular member from said second to said first position.

5. A device as defined in claim 1 in which said fourth means includes:

f. a second confined space defining structure;

g. a conduit that extends from said opening in said tubular member to the interior of said second confined space defining structure; and h. pump means in communication with the interior of said second confined space defining structure for pumping water therefrom to drain water from said first confined space there into and evacuate said first confined space prior to said ram moving from said first to said second position.

6. A device as defined in claim 5 in which said conduit has a valve therein that may occupy either a closed or open position, with said valve being closed when said ram is moved from said second to said first position, and open when said ram moves from said first to said second position.

7. A device as defined in claim 1 in which said second means is a toothed vertically disposed rack secured to said ram, and a power driven sprocket rotatably supported from said tubular member in engagement with said rack.

8. A device as defined in claim 1 in which said first means are a plurality of flat pivotally supported members on said ram that sealingly overlap one another when in said first position.

9. A method of driving a pile that is a substantial distance below the surface of a body of water that includes the steps of:

a. engaging an upper portion of said pile with a vertically extending tubular member said member having an upper open end;

b. positioning an anvil in said tubular member in abutting contact with said pile;

c. disposing a ram in said tubular member in slidable sealing contact with the interior thereof said ram having at least one transverse opening therein;

d. raising said ram in said tubular member to a substantial distance above said anvil, with water flowing through said transverse opening to equalize the hydraulic pressure above and below said ram;

e. closing said opening when said ram is a desired distance above said anvil;

f. evacuating the water between said ram and anvil in said tubular member;

g. allowing the hydrostatic head above said ram to drive the latter downwardly to impact said anvil, with the force of said impact being transferred to said pile to drive the latter downwardly;

h. opening said transverse opening and moving said ram upwardly to said substantial distance above said anvil and repeating the above described steps until said pile is driven to a desired depth.

* * * * *